US011166557B1

(12) United States Patent
Tsai

(10) Patent No.: US 11,166,557 B1
(45) Date of Patent: Nov. 9, 2021

(54) FOLDING CHAIR

(71) Applicant: SPORT DIVERSIONS INC., Taipei (TW)

(72) Inventor: Wen-Hao Tsai, New Taipei (TW)

(73) Assignee: SPORT DIVERSIONS INC., Taipei (TW)

( * ) Notice: Subject to any disclaimer, the term of this patent is extended or adjusted under 35 U.S.C. 154(b) by 0 days.

(21) Appl. No.: 17/087,590

(22) Filed: Nov. 2, 2020

(51) Int. Cl.
*A47C 4/28* (2006.01)

(52) U.S. Cl.
CPC ..... *A47C 4/283* (2013.01)

(58) Field of Classification Search
CPC ..... A47C 4/283; A47C 4/045
USPC ..... 297/42, 44, 45
See application file for complete search history.

(56) References Cited

U.S. PATENT DOCUMENTS

| | | | | |
|---|---|---|---|---|
| 6,854,797 | B1 * | 2/2005 | Thomas | A47C 4/34 297/16.1 |
| 2003/0025362 | A1 * | 2/2003 | Liu | A47C 5/10 297/45 |
| 2011/0169304 | A1 * | 7/2011 | Chen | A47C 4/283 297/35 |
| 2013/0106145 | A1 * | 5/2013 | Chen | A47C 4/283 297/42 |
| 2020/0205571 | A1 * | 7/2020 | Tsai | A47C 4/283 |

* cited by examiner

*Primary Examiner* — Sarah B McPartlin

(57) ABSTRACT

A folding chair includes a left supporting frame member, a left leg, a left armrest, a left seat receiver, a left front support, a left rear support, a left front connecting member, a left rear connecting member, a left backrest support, a left front support pivot, a left rear support pivot, a left front pivot, a left rear pivot, a left backrest support pivot, a right supporting frame member, a right leg, a right armrest, a right seat receiver, a right front support, a right rear support, a right front connecting member, a right rear connecting member, a right backrest support, a right front support pivot, a right rear support pivot, a right front pivot, a right rear pivot, a right backrest support pivot, a front pivoting limiter, a rear pivoting limiter, a front pivotal connector, a rear pivotal connector, a seat and a backrest.

8 Claims, 6 Drawing Sheets

FOLDING CHAIR

BACKGROUND OF THE INVENTION

1. Field of the Invention

The present disclosure relates to a folding chair, and more particularly, to a folding chair that is collapsible into a slim-folded state for storage and extendable for use.

2. Description of the Related Art

A conventional folding chair usually includes a frame, two legs, a seat and a backrest. The legs are pivotally connected to the frame in a crisscross pattern; the seat is pivotally assembled to the frame; and the backrest is assembled to a top of the frame. In this manner, the legs and the seat can be pivotally extended to one side of the frame for a user to sit on the seat, or the legs and the seat can be pivotally moved toward the frame into a collapsed state.

With regard to the above-described conventional folding chair, when it is collapsed with the legs and the seat pivotally moved toward the frame, the frame and the seat still maintain an overall width the same as that of the folding chair in the extended state. Therefore, the conventional folding chair in the collapsed state would still occupy a relatively large space and is not conveniently portable. Further, the conventional folding chair in the extended state is supported on the floor or ground only by a bottom of the frame and the two legs, which provide only limited stability and load capacity.

Thus, it is tried by the inventor to develop an improved folding chair that can be collapsed into a slim-folded state to occupy a very small space and be easily portable, and on the other hand, can be extended into a standing state with high stability and providing good load capacity in use.

BRIEF SUMMARY OF THE INVENTION

An objective of the present disclosure is to eliminate the drawbacks of the conventional folding chair by providing an improved folding chair that can be collapsed into a slim-folded state to occupy a very small space and be easily portable, and on the other hand, can be extended into a standing state with high stability and providing good load capacity in use.

To achieve at least the above objective, the folding chair according to the present disclosure includes a left supporting frame member, a left leg, a left armrest, a left seat receiver, a left front support, a left rear support, a left front connecting member, a left rear connecting member, a left backrest support, a left front support pivot, a left rear support pivot, a left front pivot, a left rear pivot, a left backrest support pivot, a right supporting frame member, a right leg, a right armrest, a right seat receiver, a right front support, a right rear support, a right front connecting member, a right rear connecting member, a right backrest support, a right front support pivot, a right rear support pivot, a right front pivot, a right rear pivot, a right backrest support pivot, a front pivoting limiter, a rear pivoting limiter, a front pivotal connector, a rear pivotal connector, a seat and a backrest. The left supporting frame member has two ends separately connected to the front pivoting limiter and the rear pivoting limiter; the left leg has two ends separately connected to the left front pivot and the left rear pivot; the left armrest has two ends separately connected to the left front pivot and the left rear pivot; the left seat receiver is connected at a front end to the left front pivot and at a rear end to the left rear pivot; the left front support is connected at an upper end to the front pivoting limiter and at a lower end to the left front support pivot, which is mounted to a lower front corner of the left leg; the left rear support is connected at an upper end to the rear pivoting limiter and at a lower end to the left rear support pivot, which is mounted to a lower rear corner of the left leg; the left front connecting member has two ends separately connected to the front pivotal connector and the left front pivot, and the left rear connecting member has two ends separately connected to the rear pivotal connector and the left rear pivot, such that the left front connecting member and the left rear connecting member are pivotally assembled to the left supporting frame member; and the left backrest support is connected at a lower end to the left backrest support pivot, which is mounted to an upper rear corner of the left armrest. The right supporting frame member has two ends separately connected to the front pivoting limiter and the rear pivoting limiter; the right leg has two ends separately connected to the right front pivot and the right rear pivot; the right armrest has two ends separately connected to the right front pivot and the right rear pivot; the right seat receiver is connected at a front end to the right front pivot and at a rear end to the right rear pivot; the right front support is connected at an upper end to the front pivoting limiter and at a lower end to the right front support pivot, which is mounted to a lower front corner of the right leg; the right rear support is connected at an upper end to the rear pivoting limiter and at a lower end to the right rear support pivot, which is mounted to a lower rear corner of the right leg; the right front connecting member has two ends separately connected to the front pivotal connector and the right front pivot, and the right rear connecting member has two ends separately connected to the rear pivotal connector and the right rear pivot, such that the right front connecting member and the right rear connecting member are pivotally assembled to the right supporting frame member; and the right backrest support is connected at a lower end to the right backrest support pivot, which is mounted to an upper rear corner of the right armrest. The seat is supported on and connected to the left seat receiver and the right seat receiver; the backrest is supported on and connected to the left backrest support and the right backrest support; and the backrest and the seat are connected to each other.

In an embodiment of the folding chair, the left supporting frame member, the left leg, the left armrest, the right supporting frame member, the right leg and the right armrest are respectively a U-shaped member.

In an embodiment of the folding chair, the front pivoting limiter includes a first coupler, a second coupler, a third coupler and a fourth coupler, which are mutually pivotally connected to one another. The first coupler is connected to one end of the left supporting frame member, the second coupler is connected to the upper end of the left front support, the third coupler is connected to one end of the right supporting frame member, and the fourth coupler is connected to the upper end of the right front support.

In an embodiment of the folding chair, the rear pivoting limiter includes a fifth coupler, a sixth coupler, a seventh coupler and an eighth coupler, which are mutually pivotally connected to one another. The fifth coupler is connected to the other end of the left supporting frame member, the sixth coupler is connected to the upper end of the left rear support, the seventh coupler is connected to the other end of the right supporting frame member, and the eighth coupler is connected to the upper end of the right rear support.

In an embodiment of the folding chair, the left front pivot includes a first union, a second union, a third union and a fourth union. The first union is connected to an upper front end of the left leg, the second union is pivotally connected to a lower front end of the left armrest, the third union is connected to a front end of the left seat receiver, and the fourth union is pivotally mounted on the left seat receiver and connected to an upper end of the left front connecting member.

In an embodiment of the folding chair, the left rear pivot includes a fifth union, a sixth union, a seventh union and an eighth union. The fifth union is connected to an upper rear end of the left leg, the sixth union is pivotally connected to a lower rear end of the left armrest, the seventh union is connected to a rear end of the left seat receiver, and the eighth union is pivotally mounted on the left seat receiver and connected to an upper end of the left rear connecting member.

In an embodiment of the folding chair, the right front pivot includes a ninth union, a tenth union, an eleventh union and a twelfth union. The ninth union is connected to an upper front end of the right leg, the tenth union is pivotally connected to a lower front end of the right armrest, the eleventh union is connected to a front end of the right seat receiver, and the twelfth union is pivotally mounted on the right seat receiver and connected to an upper end of the right front connecting member.

In an embodiment of the folding chair, the right rear pivot includes a thirteenth union, a fourteenth union, a fifteenth union and a sixteenth union. The thirteenth union is connected to an upper rear end of the right leg, the fourteenth union is pivotally connected to a lower rear end of the right armrest, the fifteenth union is connected to a rear end of the right seat receiver, and the sixteenth union is pivotally mounted on the right seat receiver and connected to an upper end of the right rear connecting member.

With the above arrangements, the folding chair of the present disclosure can be collapsed into a slim-folded state to be easily portable without occupying too much space; and the folding chair fully extended from the slim-folded state provides improved stability and load capacity in use.

DETAILED DESCRIPTION OF THE INVENTION

Figure 1:
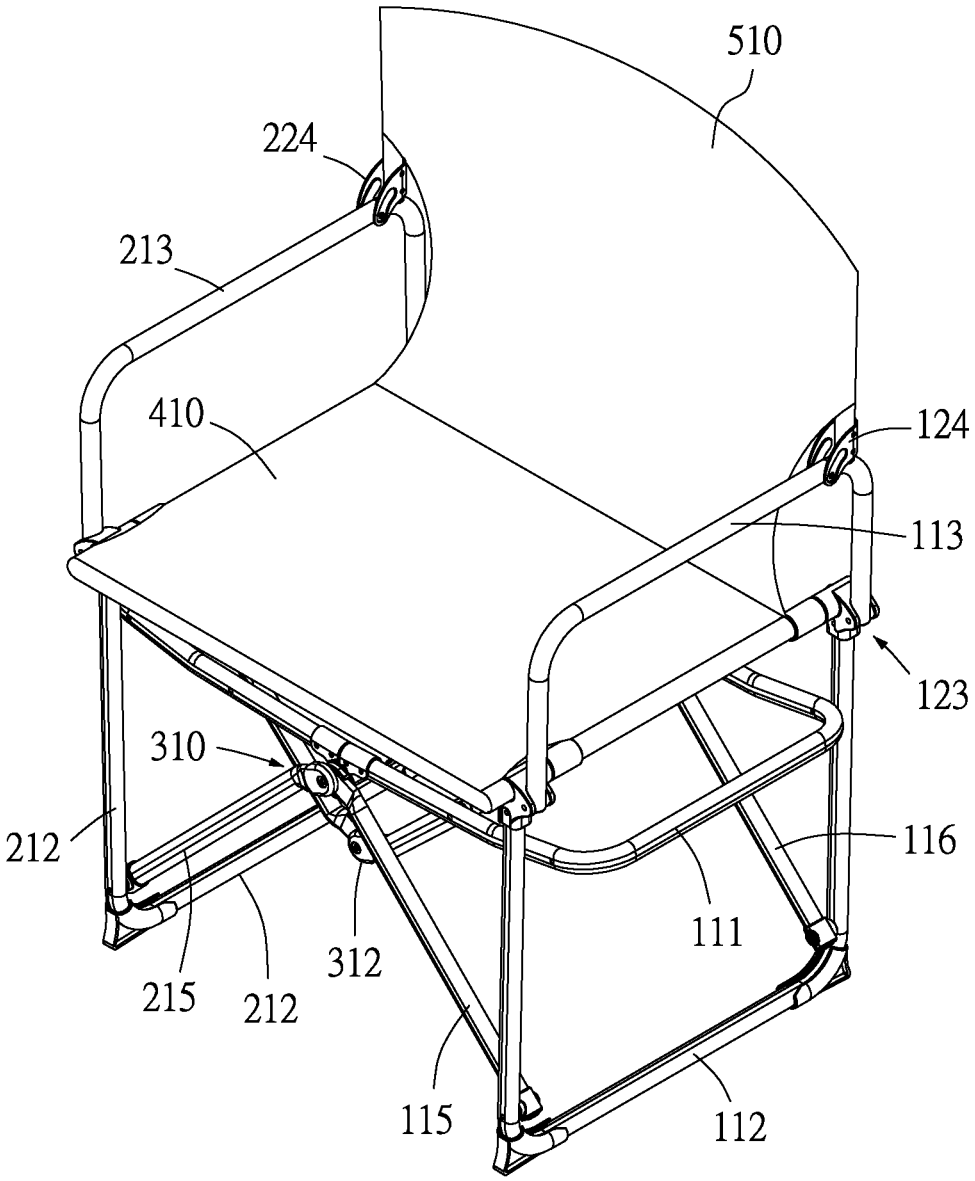
FIG. 1 is a perspective view of a folding chair according to an embodiment of the present disclosure, showing the folding chair in a fully extended state.

To facilitate understanding of the objects, characteristics and effects of this present disclosure, embodiments together with the attached drawings for the detailed description of the present disclosure are provided. It is noted the present disclosure can be implemented or applied in other embodiments, and many changes and modifications in the described embodiments can be carried out without departing from the spirit of the disclosure, and it is also understood that the preferred embodiments are only illustrative and not intended to limit the present disclosure in any way.

Please refer to FIGS. 1 to 6. As shown, the folding chair according to an embodiment of the present disclosure includes a U-shaped left supporting frame member 111, a U-shaped left leg 112, a U-shaped left armrest 113, a left seat receiver 114, a left front support 115, a left rear support 116, a left front connecting member 117, a left rear connecting member 118, a left backrest support 119, a left front support pivot 120, a left rear support pivot 121, a left front pivot 122, a left rear pivot 123, a left backrest support pivot 124, a U-shaped right supporting frame member 211, a U-shaped right leg 212, a U-shaped right armrest 213, a right seat receiver 214, a right front support 215, a right rear support 216, a right front connecting member 217, a right rear connecting member 218, a right backrest support 219, a right front support pivot 220, a right rear support pivot 221, a right front pivot 222, a right rear pivot 223, a right backrest support pivot 224, a front pivoting limiter 310, a rear pivoting limiter 311, a front pivotal connector 312, a rear pivotal connector 313, a seat 410, and a backrest 510.

The left supporting frame member 111 has two ends separately connected to the front pivoting limiter 310 and the rear pivoting limiter 311; the left leg 112 has two ends separately connected to the left front pivot 122 and the left rear pivot 123; the left armrest 113 has two ends separately connected to the left front pivot 123 and the left rear pivot 123; the left seat receiver 114 is connected at a front end to the left front pivot 122 and at a rear end to the left rear pivot 123; the left front support 115 is connected at an upper end to the front pivoting limiter 310 and at a lower end to the left front support pivot 120, which is mounted to a lower front corner of the left leg 112; the left rear support 116 is connected at an upper end to the rear pivoting limiter 311 and at a lower end to the left rear support pivot 121, which is mounted to a lower rear corner of the left leg 112; the left front connecting member 117 has two ends separately connected to the front pivotal connector 312 and the left front pivot 122, and the left rear connecting member 118 has two ends separately connected to the rear pivotal connector 313 and the left rear pivot 123, such that the left front connecting member 117 and the left rear connecting member 118 are pivotally assembled to the left supporting frame member 111; and the left backrest support 119 is connected at a lower end to the left backrest support pivot 124, which is mounted to an upper rear corner of the left armrest 113.

The right supporting frame member 211 has two ends separately connected to the front pivoting limiter 310 and the rear pivoting limiter 311; the right leg 212 has two ends separately connected to the right front pivot 222 and the right rear pivot 223; the right armrest 213 has two ends separately connected to the right front pivot 222 and the right rear pivot 223; the right seat receiver 214 is connected at a front end to the right front pivot 222 and at a rear end to the right rear pivot 223; the right front support 215 is connected at an upper end to the front pivoting limiter 310 and at a lower end to the right front support pivot 220, which is mounted to a lower front corner of the right leg 212; the right rear support 216 is connected at an upper end to the rear pivoting limiter 311 and at a lower end to the right rear support pivot 221, which is mounted to a lower rear corner of the right leg 212; the right front connecting member 217 has two ends separately connected to the front pivotal connector 312 and the right front pivot 222, and the right rear connecting member 218 has two ends separately connected to the rear pivotal connector 313 and the right rear pivot 223, such that the right front connecting member 217 and the right rear connecting member 218 are pivotally assembled to the right supporting frame member 211; and the right backrest support 219 is connected at a lower end to the right backrest support pivot 224, which is mounted to an upper rear corner of the right armrest 213.

The seat 410 is supported on and connected to the left seat receiver 114 and the right seat receiver 214; and the backrest 510 is supported on and connected to the left backrest support 119 and the right backrest support 219. Wherein, the backrest 510 and the seat 410 are connected to each other, as shown in FIG. 1. In this way, a user may sit on the seat 410 with his/her back rest on the backrest 510 in a very comfortable manner.

Figure 2:
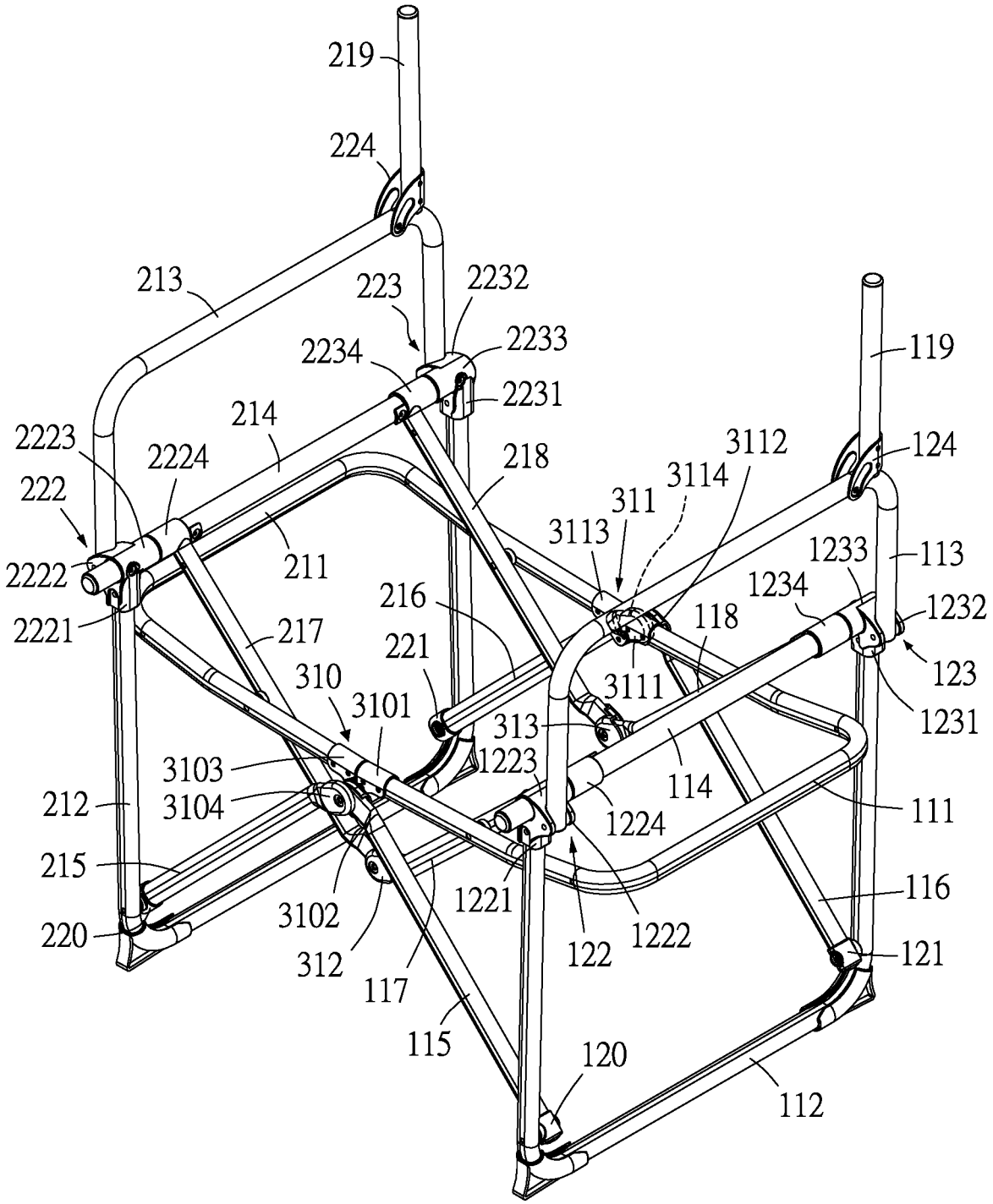
FIG. 2 is a perspective view of the folding chair of FIG. 1 in the extended state with a seat and a backrest omitted therefrom.
Figure 3:
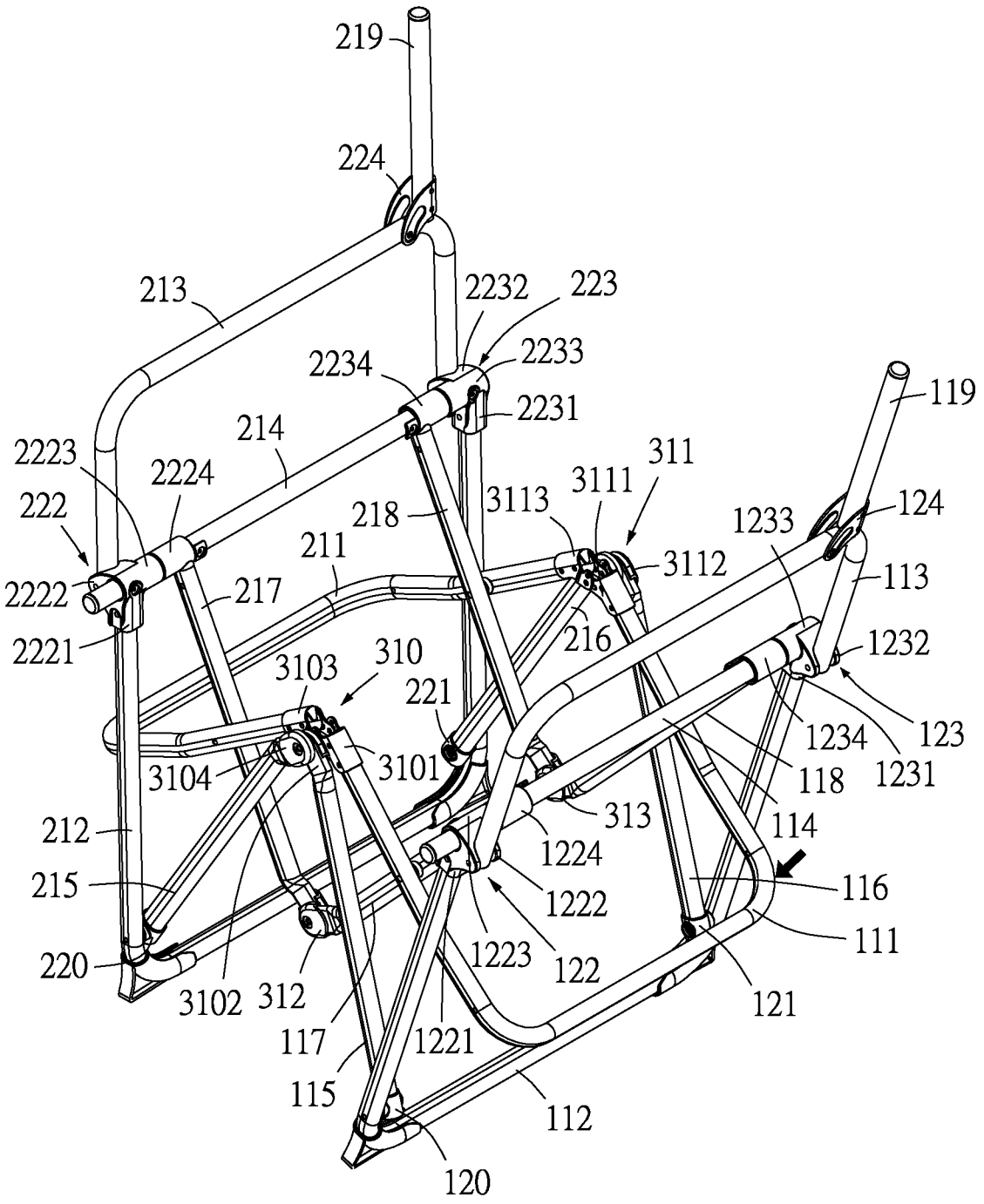
FIG. 3 is a perspective view showing the folding chair of FIG. 2 without the seat and the backrest is partially collapsed.
Figure 4:
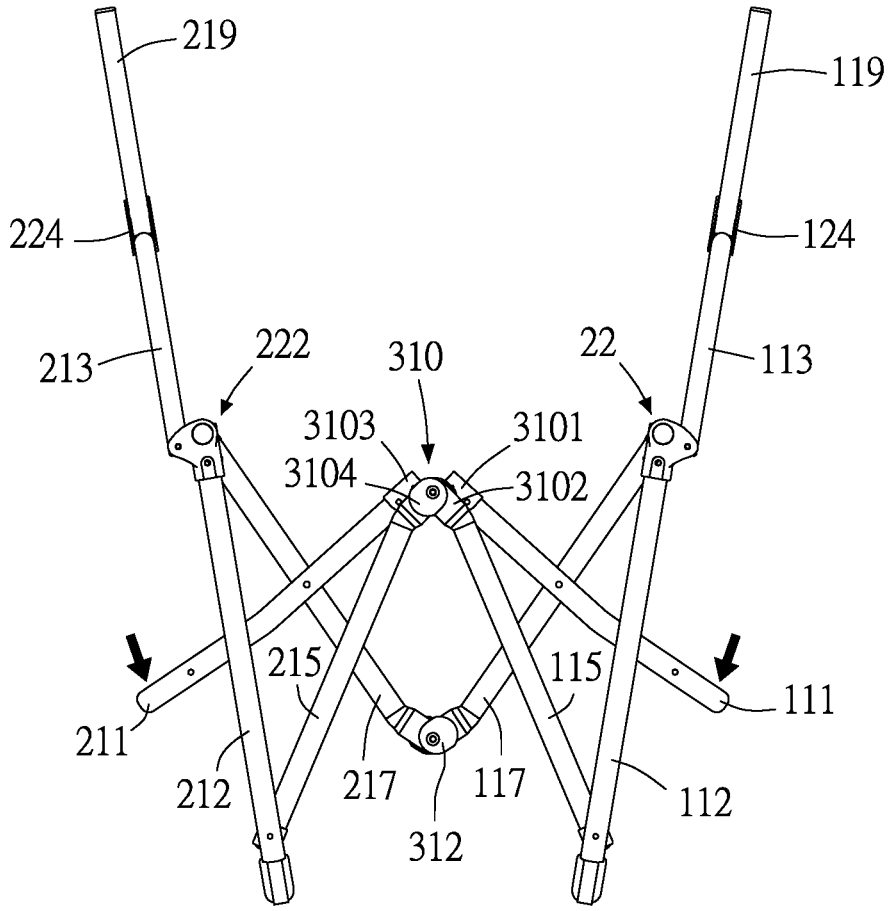
FIG. 4 is a front view of FIG. 3.

As shown in FIGS. 2 to 6, to collapse the folding chair according to the present disclosure, simply apply a downward force on the left supporting frame member 111 and the right supporting frame member 211. At this point, as shown in FIGS. 3 and 4, the left supporting frame member 111 and the right supporting frame member 211 are pivotally turned about the front pivoting limiter 310 and the rear pivoting limiter 311 to decline toward the left leg 112 and the right leg 212, respectively.

Figure 5:
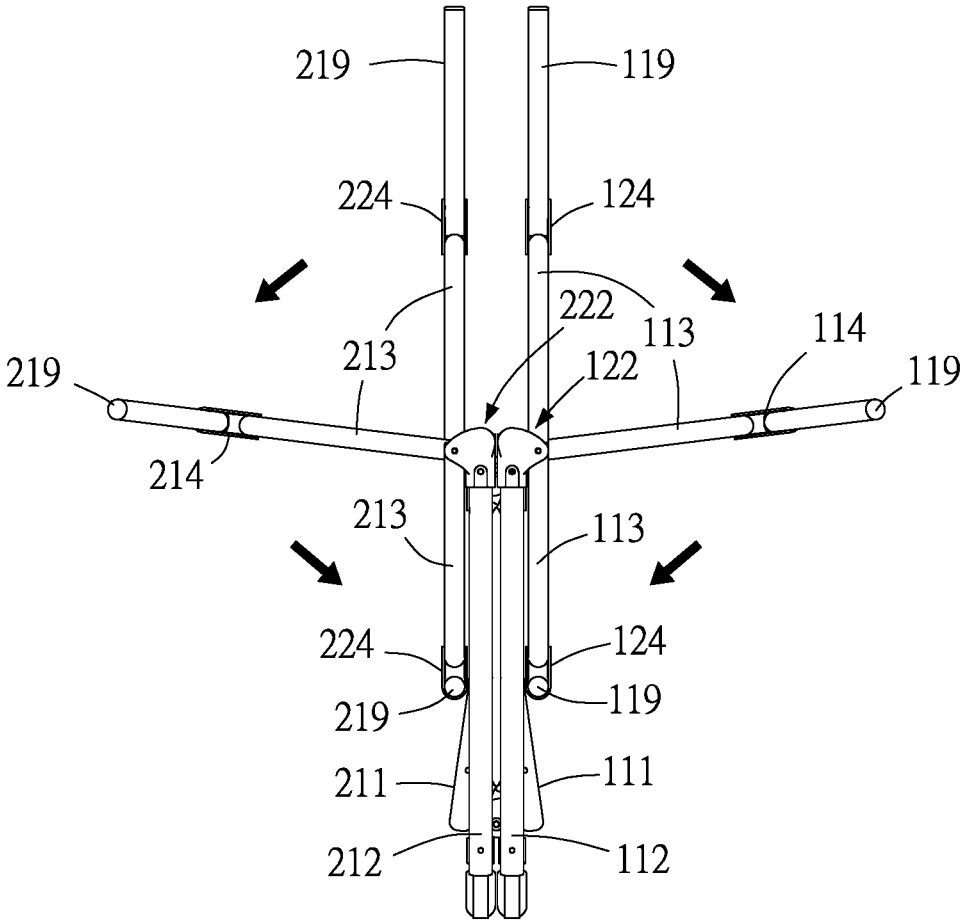
FIG. 5 is a perspective view showing the folding chair of FIG. 2 without the seat and the backrest is almost fully collapsed.
Figure 6:
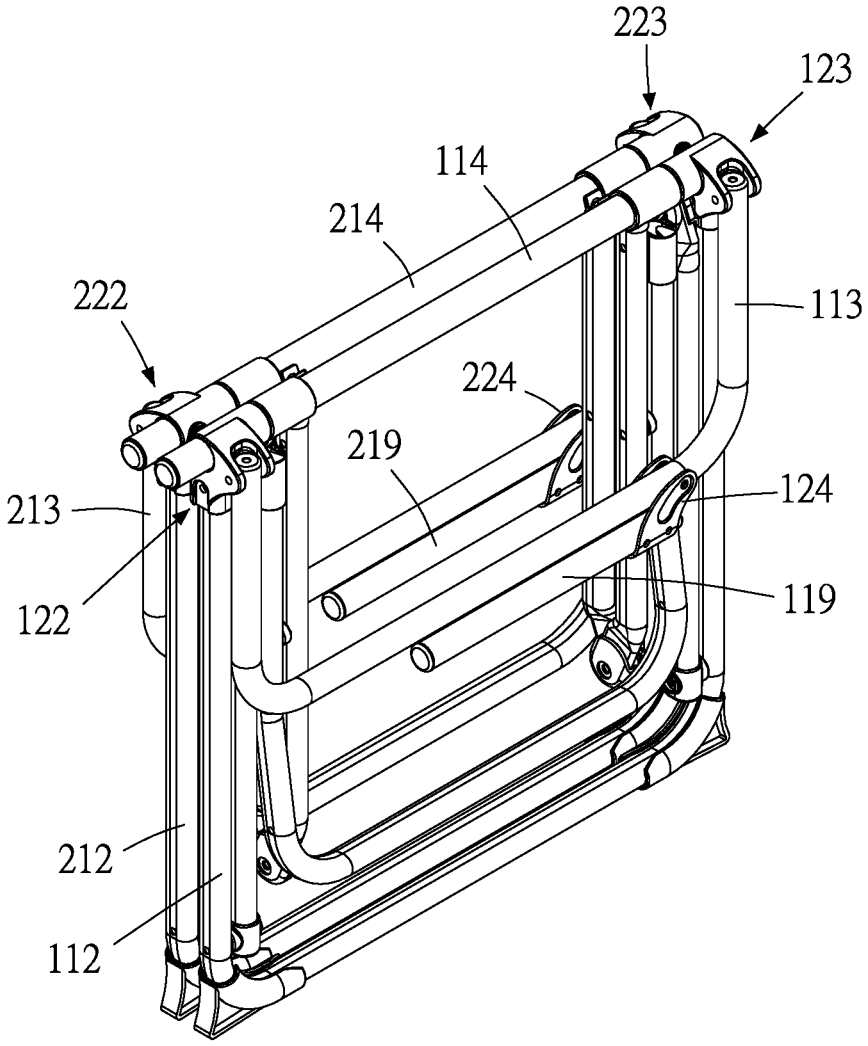
FIG. 6 is a perspective view showing the folding chair of FIG. 2 without the seat and the backrest is fully collapsed into a slim-folded state.

Please refer to FIGS. 3 and 4. When the left and the right supporting frame member 111, 211 are declined toward the left leg 112 and the right leg 212, respectively, the left front support 115 and the right front support 215 are synchronously brought to pivotally turn about the front pivoting limiter 310, which further brings the left front support pivot 120 and the right front support pivot 220 to pivotally turn. As a result, the left front support 115 and the right front support 215 are brought to move toward each other. Similarly, the left rear support 116 and the right rear support 216 are synchronously brought to pivotally turn about the rear pivoting limiter 311, which further brings the left rear support pivot 121 and the right rear support pivot 221 to pivotally turn. As a result, the left rear support 116 and the right rear support 216 are brought to move toward each other. Similarly, the left front connecting member 117 and the right front connecting member 217 are synchronously brought to pivotally turn about the first front pivotal connector 312, which further brings the left front pivot 122 and the right front pivot 222 to pivotally turn. As a result, the left front connecting member 117 and the right front connecting member 217 are brought to move toward each other. Similarly, the left rear connecting member 118 and the right rear connecting member 218 are synchronously brought to pivotally turn about the rear pivotal connector 313, which further brings the left rear pivot 123 and the right rear pivot 223 to pivotally turn. As a result, the left rear connecting member 118 and the right rear connecting member 218 are brought to move toward each other. Thereafter, as shown in FIG. 5, move the left leg 112 and the right leg 212 toward each other. Finally, pivotally turn the left armrest 113 about the left front pivot 122 and the left rear pivot 123 to move the left armrest 113 toward the left leg 112, pivotally turn the right armrest 213 about the right front pivot 222 and the right rear pivot 224 to move the right armrest 213 toward the right leg 212, pivotally turn the left backrest support 119 about the left backrest support pivot 124 to move the left backrest support 119 toward the left armrest 113, and pivotally turn the right backrest support 219 about the right backrest support pivot 224 to move the right backrest support 219 toward the right armrest 213. At this point, the folding chair is fully collapsed into a slim-folded state as shown in FIG. 6. The folding chair in the fully slim-folded state occupies a very small space and is easily portable.

As shown in FIG. 2, the left supporting frame member 111, the left leg 112, the left armrest 113, the left seat receiver 114, the left front support 115, the left rear support 116, the left front connecting member 117, the left rear connecting member 118, the left backrest support 119, the right supporting frame member 211, the right leg 212, the right armrest 213, the right seat receiver 214, the right front support 215, the right rear support 216, the right front connecting member 217, the right rear connecting member 218 and the right backrest support 219 of the folding chair in the slim-folded state can be extended by correspondingly pivotally turning them about the front pivoting limiter 310, the rear pivoting limiter 311, the front pivotal connector 312, the rear pivotal connector 313, the left front support pivot 120, the left rear support pivot 121, the left front pivot 122, the left rear pivot 123, the left backrest support pivot 124, the right front support pivot 220, the right rear support 221, the right front pivot 222, the right rear pivot 223 and the right backrest support pivot 224. And, the folding chair in the fully extended state provides good stability and load capacity in use.

In the embodiment illustrated in FIG. 2, the left supporting frame member 111, the left leg 112, the right supporting frame member 211 and the right leg 212 are respectively a U-shaped member; and the left armrest 113 and the right armrest 213 are respectively an inverted U-shaped member. With this design, these members can be simultaneously pivotally turned at the front pivoting limiter 310, the rear pivoting limiter 311, the front pivotal connector 312, the rear pivotal connector 313, the left front support pivot 120, the left rear support pivot 121, the left front pivot 122, the left rear pivot 123, the right front support pivot 220, the right rear support pivot 221, the right front pivot 222 and the right rear pivot 223 and moved smoothly like in a linkage gearing when collapsing or extending the folding chair. And, the folding chair in the fully extended state provides good stability and load capacity in use.

In the embodiment illustrated in FIG. 2, the front pivoting limiter 310 includes a first coupler 3101, a second coupler 3102, a third coupler 3103 and a fourth coupler 3104, which are mutually pivotally connected to one another. The first coupler 3101 is connected to one end of the left supporting frame member 111, the second coupler 3102 is connected to the upper end of the left front support 115, the third coupler 3103 is connected to one end of the right supporting frame member 211, and the fourth coupler 3104 is connected to the upper end of the right front support 215. With these arrangements, the left supporting frame member 111, the left front support 115, the right supporting frame member 211 and the right front support 215 can be smoothly pivotally turned about the front pivoting limiter 310 simultaneously when collapsing or extending the folding chair. And, the fully extended folding chair provides improved stability and load capacity in use.

In the embodiment illustrated in FIG. 2, the rear pivoting limiter 311 includes a fifth coupler 3111, a sixth coupler 3112, a seventh coupler 3113 and an eighth coupler 3114, which are mutually pivotally connected to one another. The fifth coupler 3111 is connected to the other end of the left supporting frame member 111, the sixth coupler 3112 is connected to the upper end of the left rear support 116, the seventh coupler 3113 is connected to the other end of the right supporting frame member 211, and the eighth coupler 3114 is connected to the upper end of the right rear support 216. With these arrangements, the left supporting frame member 111, the left rear support 116, the right supporting frame member 211 and the right rear support 216 can be smoothly pivotally turned about the rear pivoting limiter 311 simultaneously when collapsing or extending the folding chair. And, the fully extended folding chair provides improved stability and load capacity in use.

In the embodiment illustrated in FIG. 2, the left front pivot 122 includes a first union 1221, a second union 1222, a third union 1223 and a fourth union 1224. The first union 1221 is connected to an upper front end of the left leg 112, the second union 1222 is pivotally connected to a lower front end of the left armrest 113, the third union 1223 is connected to a front end of the left seat receiver 114, and the fourth union 1224 is pivotally mounted on the left seat receiver 114 and connected to an upper end of the left front connecting member 117. With these arrangements, the left leg 112, the left armrest 113, the left seat receiver 114 and the left front connecting member 117 can be smoothly pivotally turned about the left front pivot 122 simultaneously when collapsing or extending the folding chair. And, the fully extended folding chair provides improved stability and load capacity in use.

In the embodiment illustrated in FIG. 2, the left rear pivot 123 includes a fifth union 1231, a sixth union 1232, a seventh union 1233 and an eighth union 1234. The fifth union 1231 is connected to an upper rear end of the left leg 112, the sixth union 1232 is pivotally connected to a lower rear end of the left armrest 113, the seventh union 1233 is connected to a rear end of the left seat receiver 114, and the eighth union 1234 is pivotally mounted on the left seat receiver 114 and connected to an upper end of the left rear connecting member 118. With these arrangements, the left leg 112, the left armrest 113, the left seat receiver 114 and the left rear connecting member 118 can be smoothly pivotally turned about the left rear pivot 123 simultaneously when collapsing or extending the folding chair. And, the fully extended folding chair provides improved stability and load capacity in use.

In the embodiment illustrated in FIG. 2, the right front pivot 222 includes a ninth union 2221, a tenth union 2222, an eleventh union 2223 and a twelfth union 2224. The ninth union 2221 is connected to an upper front end of the right leg 212, the tenth union 2222 is pivotally connected to a lower front end of the right armrest 213, the eleventh union 2223 is connected to a front end of the right seat receiver 214, and the twelfth union 2224 is pivotally mounted on the right seat receiver 214 and connected to an upper end of the right front connecting member 217. With these arrangements, the right leg 212, the right armrest 213, the right seat receiver 214 and the right front connecting member 217 can be smoothly pivotally turned about the right front pivot 2122 simultaneously when collapsing or extending the folding chair. And, the fully extended folding chair provides improved stability and load capacity in use.

In the embodiment illustrated in FIG. 2, the right rear pivot 223 includes a thirteenth union 2231, a fourteenth union 2232, a fifteenth union 2233 and a sixteenth union 2234. The thirteenth union 2231 is connected to an upper rear end of the right leg 212, the fourteenth union 2232 is pivotally connected to a lower rear end of the right armrest 213, the fifteenth union 2233 is connected to a rear end of the right seat receiver 214, and the sixteenth union 2234 is pivotally mounted on the right seat receiver 214 and connected to an upper end of the right rear connecting member 218. With these arrangements, the right leg 212, the right armrest 213, the right seat receiver 214 and the right rear connecting member 218 can be smoothly pivotally turned about the right rear pivot 223 simultaneously when collapsing or extending the folding chair. And, the fully extended folding chair provides improved stability and load capacity in use.

While the present disclosure has been described by means of a specific embodiment, numerous modifications and variations could be made thereto by those skilled in the art without departing from the scope and spirit of the present disclosure set forth in the claims.

What is claimed is:

1. A folding chair, comprising:

a left supporting frame member, a left leg, a left armrest, a left seat receiver, a left front support, a left rear support, a left front connecting member, a left rear connecting member, a left backrest support, a left front support pivot, a left rear support pivot, a left front pivot, a left rear pivot, a left backrest support pivot, a right supporting frame member, a right leg, a right armrest, a right seat receiver, a right front support, a right rear support, a right front connecting member, a right rear connecting member, a right backrest support, a right front support pivot, a right rear support pivot, a right front pivot, a right rear pivot, a right backrest support pivot, a front pivoting limiter, a rear pivoting limiter, a front pivotal connector, a rear pivotal connector, a seat and a backrest;

the left supporting frame member having two ends separately connected to the front pivoting limiter and the rear pivoting limiter; the left leg having two ends separately connected to the left front pivot and the left rear pivot; the left armrest having two ends separately connected to the left front pivot and the left rear pivot; the left seat receiver being connected at a front end to the left front pivot and at a rear end to the left rear pivot; the left front support being connected at an upper end to the front pivoting limiter and at a lower end to the left front support pivot, which is mounted to a lower front corner of the left leg; the left rear support being connected at an upper end to the rear pivoting limiter and at a lower end to the left rear support pivot, which is mounted to a lower rear corner of the left leg; the left front connecting member having two ends separately connected to the front pivotal connector and the left front pivot, and the left rear connecting member having two ends separately connected to the rear pivotal connector and the left rear pivot, such that the left front connecting member and the left rear connecting member are pivotally assembled to the left supporting frame member; and the left backrest support being connected at a lower end to the left backrest support pivot, which is mounted to an upper rear corner of the left armrest;

the right supporting frame member having two ends separately connected to the front pivoting limiter and the rear pivoting limiter; the right leg having two ends separately connected to the right front pivot and the right rear pivot; the right armrest having two ends separately connected to the right front pivot and the right rear pivot; the right seat receiver being connected at a front end to the right front pivot and at a rear end to the right rear pivot; the right front support being connected at an upper end to the front pivoting limiter and at a lower end to the right front support pivot, which is mounted to a lower front corner of the right leg; the right rear support being connected at an upper end to the rear pivoting limiter and at a lower end to the right rear support pivot, which is mounted to a lower rear corner of the right leg; the right front connecting member having two ends separately connected to the front pivotal connector and the right front pivot, and the right rear connecting member having two ends separately connected to the rear pivotal connector and the right rear pivot, such that the right front connecting member and the right rear connecting member are pivotally assembled to the right supporting frame member; and the right backrest support being connected at a lower end to the right backrest support pivot, which is mounted to an upper rear corner of the right armrest; and the seat being supported on and connected to the left seat receiver and the right seat receiver; the backrest being supported on and connected to the left backrest support and the right backrest support; and the backrest and the seat being connected to each other.

2. The folding chair according to claim 1, wherein the left supporting frame member, the left leg, the right supporting frame member and the right leg are respectively a U-shaped member; and the left armrest and the right armrest are respectively an inverted U-shaped member.

3. The folding chair according to claim 1, wherein the front pivoting limiter includes a first coupler, a second coupler, a third coupler and a fourth coupler, which are mutually pivotally connected to one another; the first coupler being connected to one end of the left supporting frame member, the second coupler being connected to the upper end of the left front support, the third coupler being connected to one end of the right supporting frame member, and the fourth coupler being connected to the upper end of the right front support.

4. The folding chair according to claim 1, wherein the rear pivoting limiter includes a fifth coupler, a sixth coupler, a seventh coupler and an eighth coupler, which are mutually pivotally connected to one another; the fifth coupler being connected to the other end of the left supporting frame member, the sixth coupler being connected to the upper end of the left rear support, the seventh coupler being connected to the other end of the right supporting frame member, and the eighth coupler being connected to the upper end of the right rear support.

5. The folding chair according to claim 1, wherein the left front pivot includes a first union, a second union, a third union and a fourth union; the first union being connected to an upper front end of the left leg, the second union being pivotally connected to a lower front end of the left armrest, the third union being connected to a front end of the left seat receiver, and the fourth union being pivotally mounted on the left seat receiver and connected to an upper end of the left front connecting member.

6. The folding chair according to claim 1, wherein the left rear pivot includes a fifth union, a sixth union, a seventh union and an eighth union; the fifth union being connected to an upper rear end of the left leg, the sixth union being pivotally connected to a lower rear end of the left armrest, the seventh union being connected to a rear end of the left seat receiver, and the eighth union being pivotally mounted on the left seat receiver and connected to an upper end of the left rear connecting member.

7. The folding chair according to claim 1, wherein the right front pivot includes a ninth union, a tenth union, an eleventh union and a twelfth union; the ninth union being connected to an upper front end of the right leg, the tenth union being pivotally connected to a lower front end of the right armrest, the eleventh union being connected to a front end of the right seat receiver, and the twelfth union being pivotally mounted on the right seat receiver and connected to an upper end of the right front connecting member.

8. The folding chair according to claim 1, wherein the right rear pivot includes a thirteenth union, a fourteenth union, a fifteenth union and a sixteenth union; the thirteenth union being connected to an upper rear end of the right leg, the fourteenth union being pivotally connected to a lower rear end of the right armrest, the fifteenth union being connected to a rear end of the right seat receiver, and the sixteenth union being pivotally mounted on the right seat receiver and connected to an upper end of the right rear connecting member.

* * * * *